US009296959B2

(12) United States Patent
Gillis

(10) Patent No.: US 9,296,959 B2
(45) Date of Patent: Mar. 29, 2016

(54) INTEGRATION OF SOLVENT DEASPHALTING WITH RESIN HYDROPROCESSING AND WITH DELAYED COKING

(71) Applicant: Foster Wheeler USA Corporation, Houston, TX (US)

(72) Inventor: Daniel B. Gillis, Houston, TX (US)

(73) Assignee: Foster Wheeler USA Corporation, Houston, TX (US)

( * ) Notice: Subject to any disclaimer, the term of this patent is extended or adjusted under 35 U.S.C. 154(b) by 112 days.

(21) Appl. No.: 13/833,884

(22) Filed: Mar. 15, 2013

(65) Prior Publication Data

US 2013/0240407 A1 Sep. 19, 2013

Related U.S. Application Data

(60) Provisional application No. 61/612,855, filed on Mar. 19, 2012.

(51) Int. Cl.

| | |
|---|---|
| ***C10G 67/04*** | (2006.01) |
| ***C10G 69/06*** | (2006.01) |
| ***C10G 55/04*** | (2006.01) |
| ***C10G 67/00*** | (2006.01) |
| ***C10G 9/00*** | (2006.01) |
| ***C10G 21/00*** | (2006.01) |
| *C10G 53/06* | (2006.01) |

(52) U.S. Cl.

CPC ..... *C10G 67/0454* (2013.01); *C10G 9/005* (2013.01); *C10G 21/003* (2013.01); *C10G 55/04* (2013.01); *C10G 67/00* (2013.01); *C10G 67/049* (2013.01); *C10G 69/06* (2013.01)

(58) Field of Classification Search

CPC .. C10G 69/06; C10G 21/003; C10G 67/0454; C10G 67/0472; C10G 67/0481; C10G 67/049

USPC ..... 208/86–87, 131, 309

See application file for complete search history.

(56) References Cited

U.S. PATENT DOCUMENTS

| | | | | |
|---|---|---|---|---|
| 3,775,292 | A | 11/1973 | Watkins | |
| 4,394,250 | A * | 7/1983 | Grossberg | 208/108 |
| 4,747,936 | A * | 5/1988 | Penning | 208/251 R |
| 6,332,975 | B1 | 12/2001 | Abdel-Halim et al. | |
| 6,533,925 | B1 | 3/2003 | Wallace et al. | |

OTHER PUBLICATIONS

Gary, J.H. et al. (2007). Petroleum Refining Technology and Economics, 5th ed., CRC Press, 465 pgs [Office action cites Figure 1.1].*

* cited by examiner

*Primary Examiner* — Brian McCaig
(74) *Attorney, Agent, or Firm* — Winstead PC

(57) ABSTRACT

The invention is directed to a process that combines the solvent deasphalting with resin hydrotreatment and coupled with delayed coking so as to reduce the costs associated with performing each of the steps separately. The integrated process of the invention permits higher product yields coupled with lower energy and transportation costs.

7 Claims, 9 Drawing Sheets

INTEGRATION OF SOLVENT DEASPHALTING WITH RESIN HYDROPROCESSING AND WITH DELAYED COKING

CROSS-REFERENCES TO RELATED APPLICATIONS

This application claims the benefit under 35 U.S.C. §119(e) of U.S. Provisional Patent Application Ser. No. 61/612,855 filed Mar. 19, 2012, which is incorporated herein by reference in its entirety as if fully set forth herein.

FIELD OF THE INVENTION

The invention relates to the solvent deasphalting of heavy oils coupled with resin hydroprocessing and with delayed coking.

BACKGROUND OF THE INVENTION

Conventionally, a solvent deasphalting (SDA) process is employed by an oil refinery for the purpose of extracting valuable components from a residual oil feedstock, which is a heavy hydrocarbon that is produced as a by-product of refining crude oil. The extracted components are fed back to the refinery wherein they are converted into valuable lighter fractions such as gasoline. Suitable residual oil feedstocks which may be used in a SDA process include, for example, atmospheric tower bottoms, vacuum tower bottoms, crude oil, topped crude oils, coal oil extract, shale oils, and oils recovered from tar sands.

In a typical SDA process, a light hydrocarbon solvent is added to the residual oil feed from a refinery and is processed in what can be termed as an asphaltene separator. Common solvents used comprise light paraffinic solvents. Examples of light paraffinic solvents include, but are not limited to, propane, butane, isobutane, pentane, isopentane, neopentane, hexane, isohexane, heptane, and similar known solvents used in deasphalting, and mixtures thereof. Under elevated temperature and pressures, the mixture in the asphaltene separator separates into a plurality of liquid streams, typically, a substantially asphaltene-free stream of deasphalted oil (DAO), resins and solvent, and a mixture of asphaltene and solvent within which some DAO may be dissolved.

Once the asphaltenes have been removed, the substantially asphaltene-free stream of DAO, resins and solvent is normally subjected to a solvent recovery system. The solvent recovery system of an SDA unit extracts a fraction of the solvent from the solvent rich DAO by boiling off the solvent, commonly using steam or hot oil from fired heaters. The vaporized solvent is then condensed and recycled back for use in the SDA unit.

Often it becomes beneficial to separate a resin product from the DAO/resin product stream. This is normally done before the solvent is removed from the DAO. "Resins" as used herein, means resins that have been separated and obtained from a SDA unit. Resins are denser or heavier than deasphalted oil, but lighter than the aforementioned asphaltenes. The resin product usually comprises more aromatic hydrocarbons with highly aliphatic substituted side chains, and can also comprise metals, such as nickel and vanadium. Generally, the resins comprise the material from which asphaltenes and DAO have been removed.

Crude oils contain heteroatomic, polyaromatic molecules that include compounds such as sulfur, nitrogen, nickel, vanadium and others in quantities that can adversely affect the refinery processing of crude oil fractions. Light crude oils or condensates have sulfur concentrations as low as 0.01 percent by weight (W %). In contrast, heavy crude oils and heavy petroleum fractions have sulfur concentrations as high as 5-6 W %. Similarly, the nitrogen content of crude oils can be in the range of 0.001-1.0 W %. These impurities must be removed during refining to meet established environmental regulations for the final products (e.g., gasoline, diesel, fuel oil), or for the intermediate refining streams that are to be processed for further upgrading, such as isomerization or reforming. Furthermore, contaminants such as nitrogen, sulfur and heavy metals are known to deactivate or poison catalysts, and thus must be removed.

Asphaltenes, which are solid in nature and comprise polynuclear aromatics present in the solution of smaller aromatics and resin molecules, are also present in the crude oils and heavy fractions in varying quantities. Asphaltenes do not exist in all of the condensates or in light crude oils; however, they are present in relatively large quantities in heavy crude oils and petroleum fractions. Asphaltenes are insoluble components or fractions and their concentrations are defined as the amount of asphaltenes precipitated by addition of an n-paraffin solvent to the feedstock.

In a typical refinery, crude oil is first fractionated in the atmospheric distillation column to separate sour gas including methane, ethane, propanes, butanes and hydrogen sulfide, naphtha (boiling point range: 36-180° C.), kerosene (boiling point range: 180-240° C.), gas oil (boiling point range: 240-370° C.) and atmospheric residue, which are the hydrocarbon fractions boiling above 370° C. The atmospheric residue from the atmospheric distillation column is either used as fuel oil or sent to a vacuum distillation unit, depending upon the configuration of the refinery. Principal products from the vacuum distillation are vacuum gas oil, comprising hydrocarbons boiling in the range 370-520° C., and vacuum residue, comprising hydrocarbons boiling above 520° C.

Naphtha, kerosene and gas oil streams derived from crude oils or other natural sources, such as shale oils, bitumens and tar sands, are treated to remove the contaminants, such as sulfur, that exceed the specification set for the end product(s). Hydrotreating is the most common refining technology used to remove these contaminants. Vacuum gas oil is processed in a hydrocracking unit to produce gasoline and diesel, or in a fluid catalytic cracking (FCC) unit to produce mainly gasoline, light cycle oil (LCO) and heavy cycle oil (HCO) as by-products, the former being used as a blending component in either the diesel pool or in fuel oil, the latter being sent directly to the fuel oil pool.

There are several processing options for the vacuum residue fraction, including hydroprocessing (including both residue hydrotreating and residue hydrocracking which includes both ebullated bed and slurry phase type reactors), coking, visbreaking, gasification and solvent deasphalting. Solvent deasphalting (SDA) is a well proven technology for separation of residues by their molecular weight and is practiced commercially worldwide. The separation in the SDA process can be into two or sometimes three components, i.e., a two component SDA process or a three component SDA process. In the SDA process, the asphaltenes rich fraction (pitch) comprising about 6-8 W % of hydrogen is separated from the vacuum residue by contact with a paraffinic solvent (carbon number ranging from 3-8) at elevated temperatures and pressures. The recovered deasphalted oil fraction (DAO) comprising about 9-11 W % hydrogen, is characterized as a heavy hydrocarbon fraction that is free of asphaltene molecules and can be sent to other conversion units such as a hydroprocessing unit (including hydrotreating and hydrocracking) or a fluid catalytic cracking unit (FCC) for further processing.

The yield of DAO is usually set by the processing feed stock property limitations, such as organometallic metals and Conradson Carbon residue (CCR) of the downstream processes. These limitations are usually below the maximum recoverable DAO within the SDA process (Table 1 and FIG. 1). Table 1 illustrates typical yields obtained in a SDA process. If the DAO yield can be increased, then the overall valuable transportation fuel yields, based on residue feed, can be increased, and the profitability of SDA enhanced. A parallel benefit would occur with the combination of SDA followed by delayed coking. Maximizing DAO yield maximizes the catalytic conversion of residue relative to thermal conversion, which occurs in delayed coking.

TABLE 1

| | FEED | DAO (HC limited) | PITCH |
|---|---|---|---|
| VOL-% | 100.00 | 53.21 | 46.79 |
| WEIGHT-% | 100.00 | 50.00 | 50.00 |
| API | 5.37 | 14.2 | −3.4 |
| Sp.Gr. | 1.0338 | 0.9715 | 1.1047 |
| S, wt-% | 4.27 | 3.03 | 5.51 |
| N, wppm | 0.3 | 0 | 0 |
| Con Carbon, wt-% | 23 | 7.7 | 38.3 |
| C7 insols, wt-% | 6.86 | 0.05 | 13.7 |
| UOP K | 11.27 | 11.54 | 11.01 |
| Ni, ppm | 24 | 2.0 | 46.0 |
| V, ppm | 94 | 5.2 | 182.8 |

Even without DAO downstream processing limitations, the cost of hydroprocessing DAO can be very high. In examining the DAO properties and its composition (Table 2), it can be seen that the back end of DAO, typically referred to as the Resin fraction, sets the severity and ultimately cost of the hydroprocessing unit. It would therefore be desirable to treat the Resin fraction separately in a cost-effective manner.

TABLE 2

| | FEED | DAO (HC limited) | RESIN | PITCH |
|---|---|---|---|---|
| VOL-% | 100.00 | 53.21 | 14.73 | 32.06 |
| WEIGHT-% | 100.00 | 50.00 | 15.00 | 35.00 |
| API | 5.37 | 14.2 | 2.9 | −6.1 |
| Sp.Gr. | 1.0338 | 0.9715 | 1.0526 | 1.1287 |
| S, wt-% | 4.27 | 3.03 | 5.09 | 5.69 |
| N, wppm | 0.3 | 0 | 0 | 1 |
| Con Carbon, wt-% | 23 | 7.7 | 23.0 | 44.8 |
| C7 insols, wt-% | 6.86 | 0.02 | 0.1 | 19.5 |
| UOP K | 11.27 | 11.54 | 11.22 | 10.92 |
| Ni, ppm | 24 | 2.0 | 14.4 | 59.6 |
| V, ppm | 94 | 5.2 | 30.2 | 248.2 |

For applications where the only downstream hydroprocessing route is hydrocracking, the quality of the DAO is much more restrictive. Even with resin hydroprocessing, the hydroprocessed resin stream may not be suitable as vacuum gas oil (VGO) Hydrocracker feedstock. Therefore, further selective separation of the hydroprocessed resin stream would be beneficial to produce additional VGO Hydrocracking feedstock for those applications where hydrocracking is the downstream hydroprocessing route.

Selective separation of hydroprocessed resin stream is also beneficial for producing additional FCC feedstock when the FCC has feedstock property limitations and to maximize yields of high value products from the FCC.

It would therefore be desirable to treat the resin fraction separately in a cost-effective manner to reduce the coking tendency of the resins stream before it is processed in the delayed coker. This should increase valuable transportation fuel yields and decrease the coke made, further increasing SDA and Coking profitability.

SUMMARY OF THE INVENTION

An embodiment of the invention is directed a solvent deasphalting process comprising: introducing a hydrocarbon oil feedstock containing asphaltenes into a mixing vessel; separating deasphalted oil into an oil fraction and a resin fraction within the solvent deasphalting process; hydrotreating the resin fraction in a dedicated resins hydroprocessing treating process; integrating the resins recovery section of the solvent deasphalting process with the resins hydroprocessing treating process; and processing the hydroprocessed treated resin in a delayed coker.

A further embodiment of the invention is directed to a method for integrating a solvent deasphalting process and a resin hydroprocessing process comprising: adding a solvent to a heavy hydrocarbon stream comprising asphaltenes, resin, and oil; removing the asphaltenes from the heavy hydrocarbon stream so as to produce a substantially solvent-free asphaltene stream and a substantially asphaltene-free solvent solution comprising the solvent, the resin, and the oil; heating the solvent solution so as to precipitate the resin; separating the resin from the solvent solution, producing a resin product and a mixture comprising the oil and the solvent; applying heat to the mixture so as to vaporize a fraction of the solvent; removing the vaporized solvent fraction from the mixture leaving a resin-free deasphalted oil product; hydroprocessing the resin product so as to produce a hydroprocessed residue product or alternately subjecting the resin product to a thermal cracking step; and subjecting the hydroprocessed residue product to a delayed coking process.

DETAILED DESCRIPTION OF EXEMPLARY EMBODIMENTS

Figure 1:
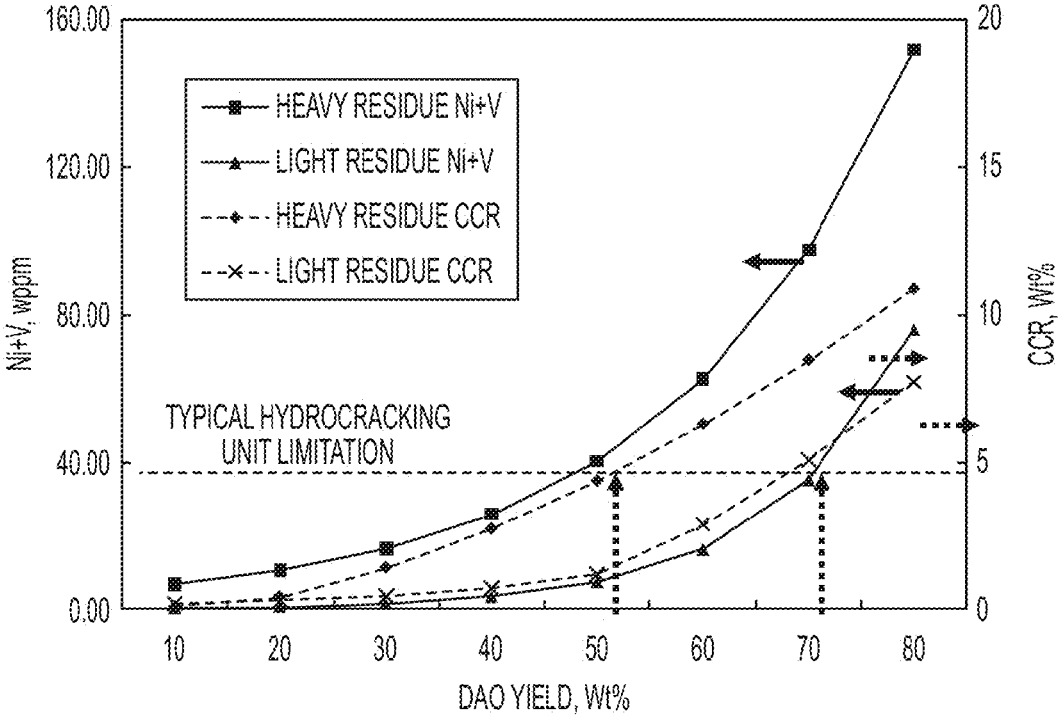
FIG. 1 shows the qualities of deasphalted oil relative to residue type and yield in accordance with an embodiment of the invention.

An embodiment of the invention includes a process comprising several steps that allow an increase in DAO yield up to the limitation of the downstream hydroprocessing or FCC feedstock limitations. FIG. 1 is an illustration of DAO contaminants versus DAO yield for different residue types.

In an embodiment of the invention an increase in DAO yield is obtained by a process comprising the steps of separating the DAO into two fractions within the solvent deasphalting (SDA) process, namely, DAO and resins; hydroprocessing the resins in a dedicated resins hydroprocessing process; integrating the resins recovery section of the SDA process with the resins hydroprocessing process, and selectively separating the hydroprocessed resin stream.

Figure 2:
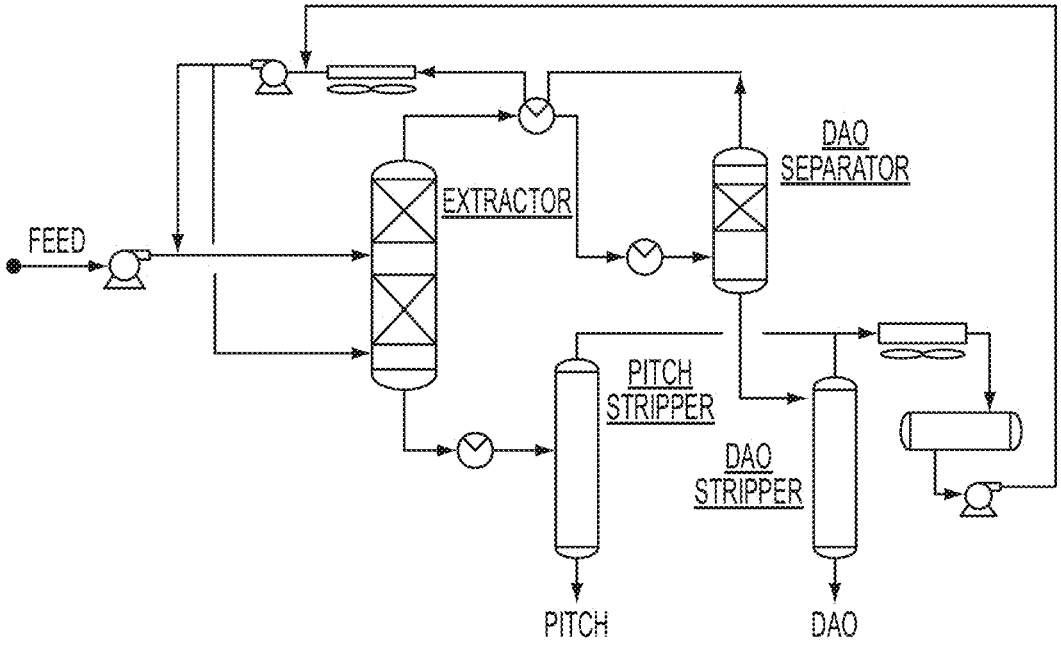
FIG. 2 shows a two product solvent deasphalting flow scheme in accordance with an embodiment of the invention.

FIG. 2 is an illustration of a two-product SDA process, where the two products are DAO and pitch (asphaltenes-rich fraction).

Figure 3:
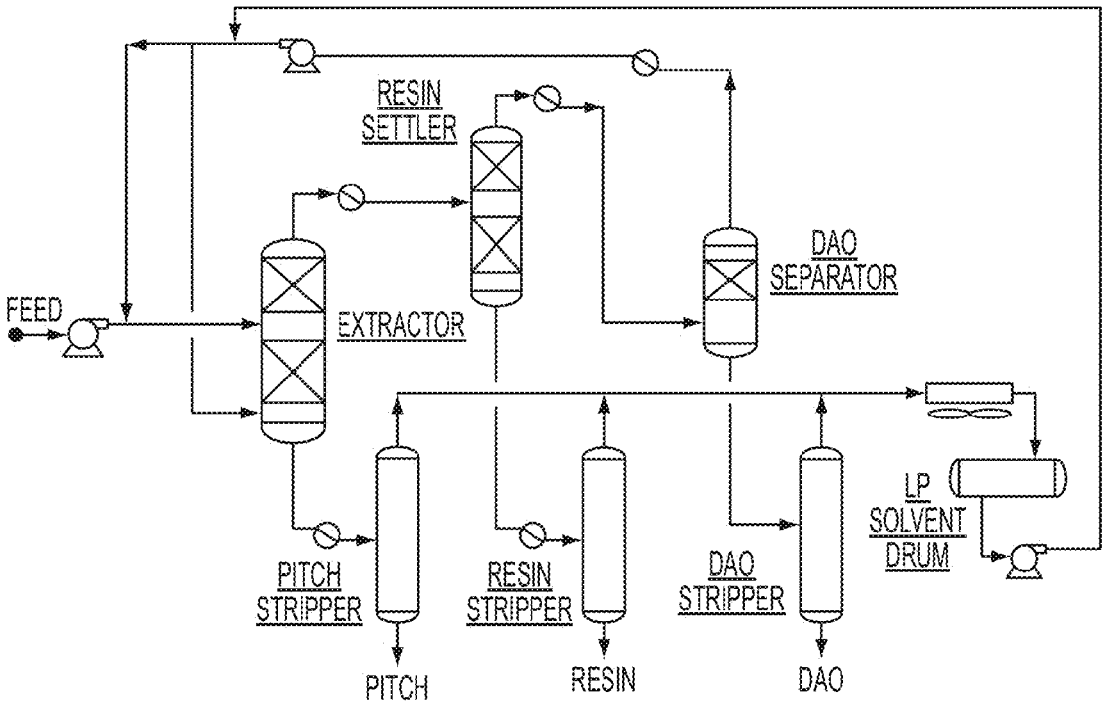
FIG. 3 shows a three product solvent deasphalting flow scheme in accordance with embodiment of the invention.
Figure 4:
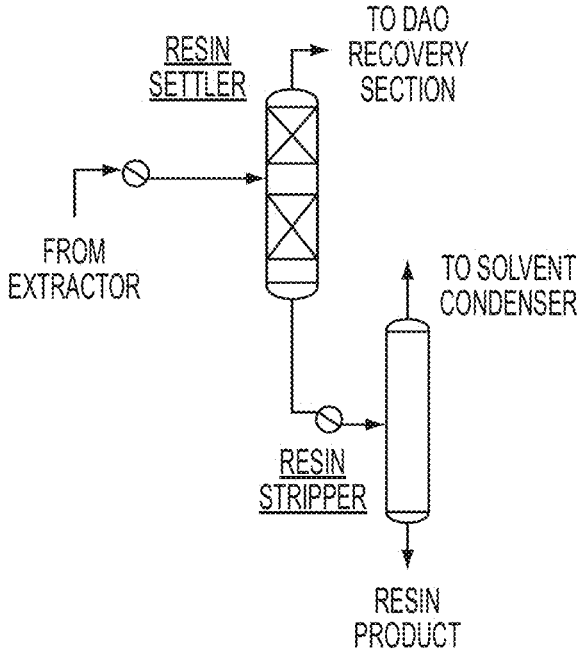
FIG. 4 shows a flow scheme for resin production in accordance with an embodiment of the invention.

Another embodiment of the invention shows a three-product SDA process, which produces, DAO, pitch and resin. To produce the intermediate resin product, an appropriate flow scheme (FIG. 3) is required. The additional equipment includes a resin settler located between the extractor and the DAO-solvent separator, additional heat exchangers, and a resin stripper to strip entrained solvent out of the resin product (FIG. 4).

In an embodiment of the invention, hydroprocessing of residues is carried out at elevated hydrogen partial pressures ranging from about 800 to about 2500 psig. In other embodiments of the invention, hydroprocessing is carried out at temperatures ranging from about 650 to about 930° F. In further embodiments of the invention, the hydroprocessing steps are performed using a catalyst made of one or more metals. Examples of metal catalysts used in embodiments of the invention include catalysts comprising iron, nickel, molybdenum, and cobalt. Metal catalysts used in embodiments of the invention promote both contaminant removal and cracking of the residues to smaller molecules contained within the hydroprocessing reactor. The process conditions used in embodiments of the invention including temperature, pressure and catalyst vary depending upon the nature of the feedstock.

The hydroprocessing reactor can either be a downflow fixed-bed reactor that contains catalyst in the reactor where the main objective is hydrotreating; an upflow ebullated bed reactor where the catalyst is suspended and it may be added and withdrawn while the reactor is in operation where the objective is some conversion and hydrotreating; or an upflow slurry phase reactor where the catalyst is added to the feed and leaves with the product out of the top of the reactor where the objective is primarily conversion.

As used herein, the term "hydroprocessing" refers to any of several chemical engineering processes including hydrogenation, hydrocracking and hydrotreating. Each of the aforementioned hydroprocessing reactions can be carried out using the hydroprocessing reactors described above.

Figure 5:
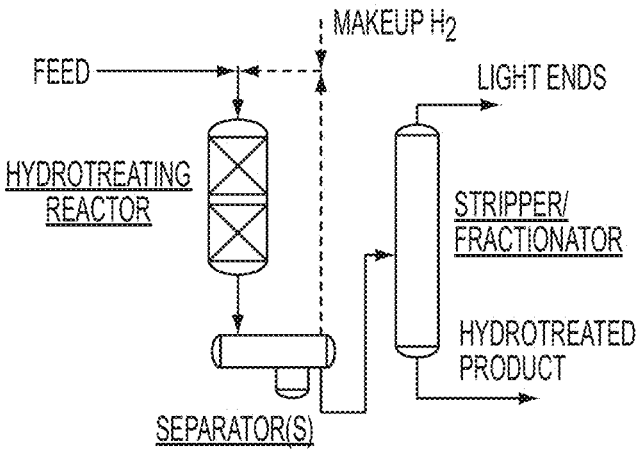
FIG. 5 shows a hydroprocessing process flow scheme in accordance with an embodiment of the invention.

Additional equipment such as pumps, heat exchangers, reactor feed heater, separation, and fractionation equipment may be required to support the hydroprocessing process. FIG. 5 highlights the key steps of a hydroprocessing process in accordance with an embodiment of the invention. Depending on the application, the flow scheme can be changed; however, the key steps of feed heating, reaction, and separation, and hydrogen rich gas addition and recycle are required.

In an embodiment of the invention, the hydroprocessing process is located downstream of the SDA process. The hydroprocessing process hydrotreats the resin fraction. The product yield benefits are fully realized with this approach.

Figure 6:
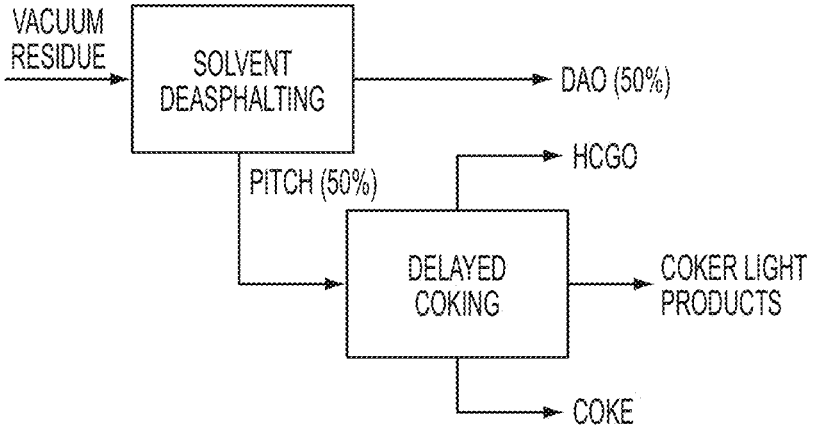
FIG. 6 shows an integrated solvent deasphalting and coking flow scheme in accordance with an embodiment of the invention.
Figure 7:
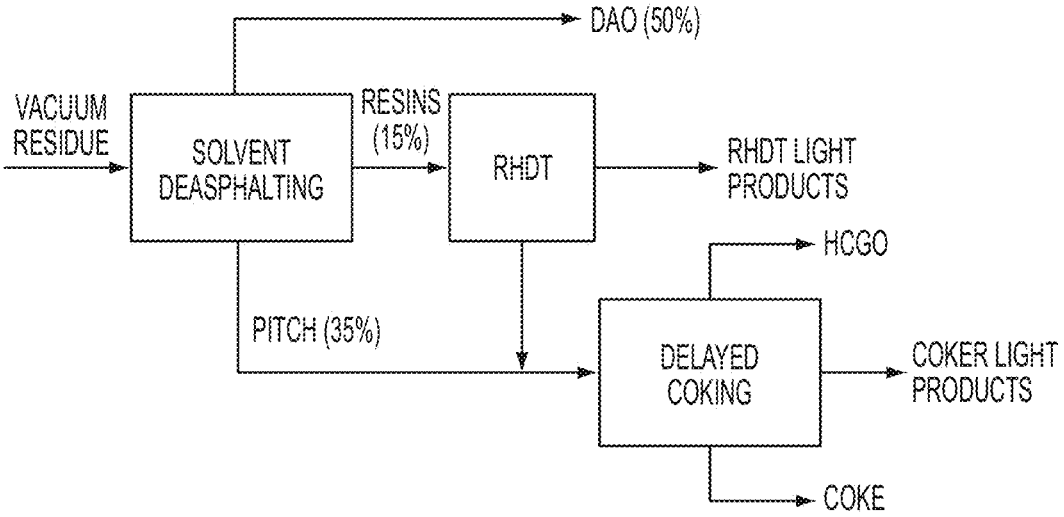
FIG. 7 shows an integrated solvent deasphalting process coupled with a resin hydroprocessing step and a coking flow scheme in accordance with an embodiment of the invention.

In an embodiment of the invention, the SDA step is coupled with the coking process As set forth in FIG. 6, the SDA Pitch is routed directly to a delayed coker. In another embodiment, as shown in FIG. 7, the process is combination of a 3 product SDA with Resin hydroprocessing following which the hydroprocessed resins are sent with the pitch to a delayed coker.

Figure 8A:
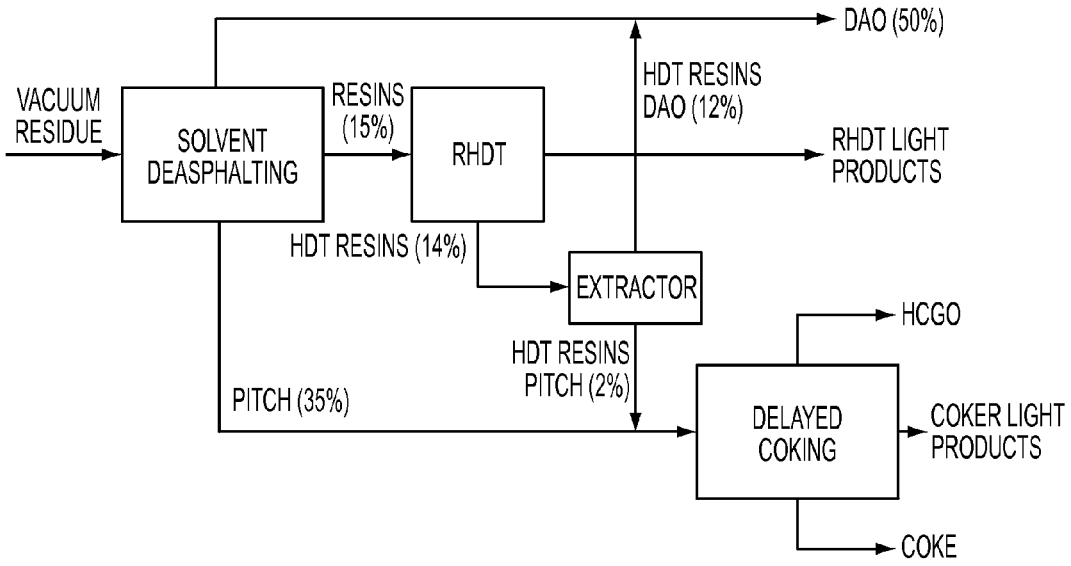
FIG. 8A shows an integrated solvent deasphalting process coupled with a resin hydroprocessing step, a resin selective separation step and a coking flow scheme in accordance with an embodiment of the invention.

FIG. 8A shows an alternative embodiment of the invention which selectively separates the hydroprocessed Resins in a third SDA Extractor. The Resins pitch product is then combined with the SDA Pitch stream and sent to a delayed coker, and the Resins DAO product is combined with the SDA DAO for processing in the downstream VGO conversion process.

Figure 8B:
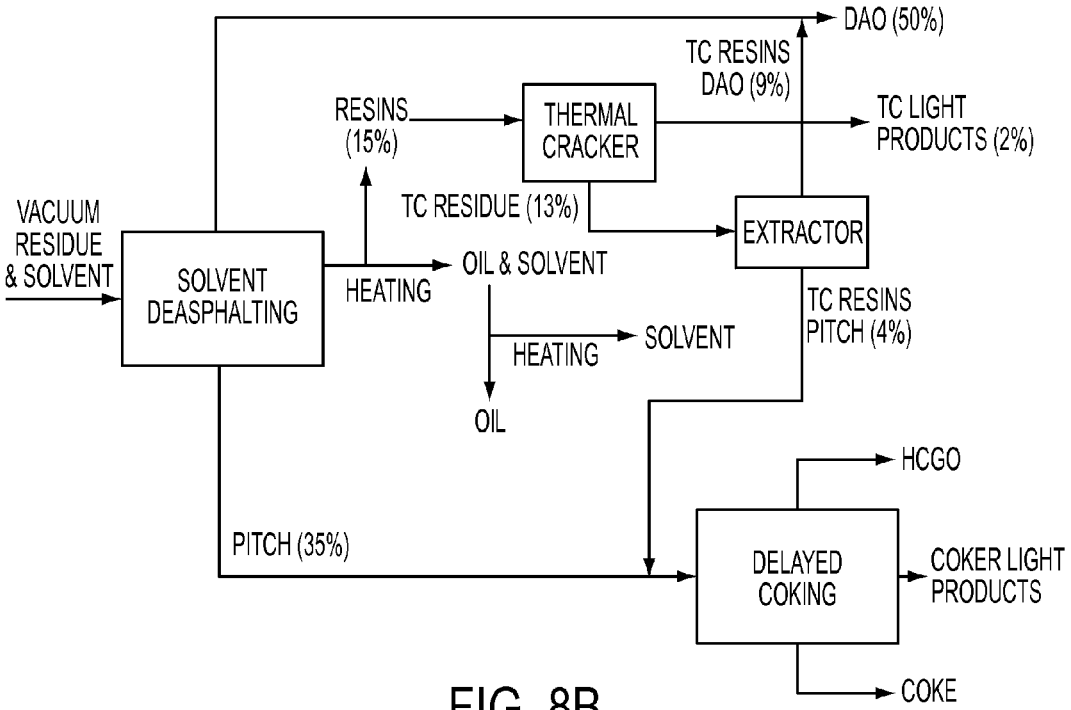
FIG. 8B shows an integrated solvent deasphalting process coupled with a thermal cracking step, a resin selective separation step and a coking flow scheme in accordance with an embodiment of the invention.

FIG. 8B shows an alternative embodiment of this invention where the resin hydroprocessing unit is replaced with a resin thermal cracking unit. The thermally cracked residues are then separated in a third SDA Extractor.

Figure 9:
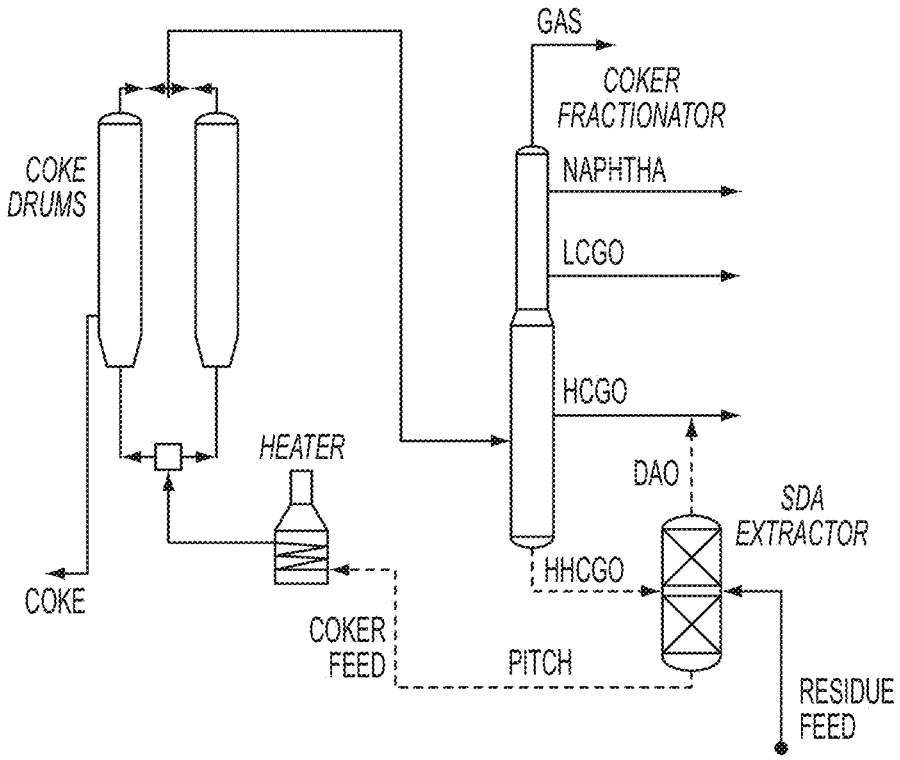
FIG. 9 shows a solvent deasphalting process coupled with the zero recycle coking that is integrated with a heavier HCGO separation process in accordance with an embodiment of the invention.

In an alternative embodiment of the invention illustrated in FIG. 9, the heaviest liquid product from the Delayed Coker is routed to the upstream SDA unit to further recover additional VGO conversion feedstock.

Figure 10:
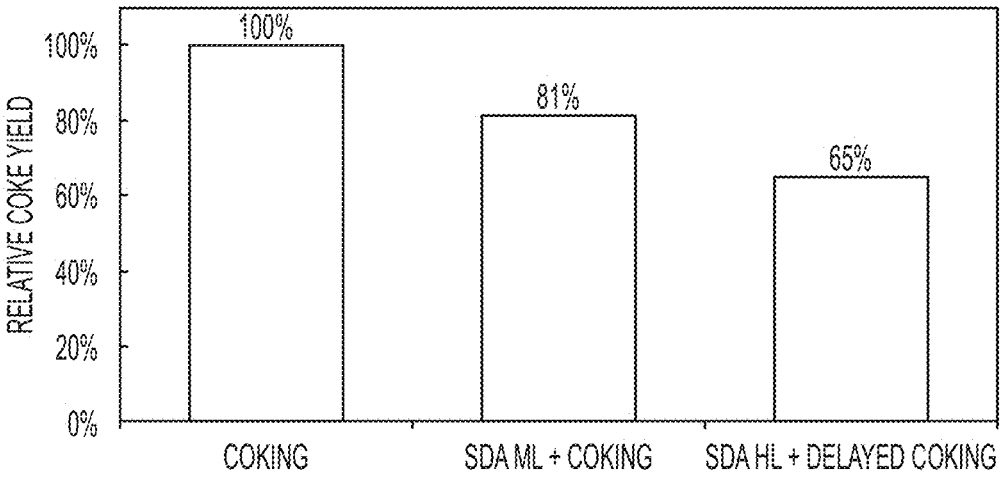
FIG. 10 shows the impact of resin hydroprocessing on coke yield in accordance with an embodiment of the invention.

In an embodiment of the invention, relative to delayed coking of vacuum residue, the addition of a SDA process in front of a delayed coking process reduces the coke made by 19 W %, where the DAO yield limitation is about 50 W % for a downstream VGO Hydrocracking Process. With the proposed resin draw, the coke made is reduced a further 15 W % for about a total 35 W % coke reduction compared to processing 100% vacuum residue (FIG. 10).

The above set of conditions is an example for a specific feedstock and refinery application. Specific base yields and with the proposed resin draw could have different yields.

In a further embodiment of the invention, production of more desirable products, such as transportation fuels, occurs when the resin stream is processed in a downstream catalytic conversion process. As shown in Table 3, liquid yields will typically be increased by about 5-8 W %, light hydrocarbons reduced by about 2-3 W %, and net coke made reduced by about 4 W %. It should be noted that the yields of product obtained using processes of the invention are dependent upon the nature of the feedstock material and process conditions.

TABLE 3

| | FEED | DAO (HC limited) | RESIN | RESIN (after Hdt) | PITCH |
|---|---|---|---|---|---|
| VOL-% | 100.00 | 53.21 | 14.73 | 14.16 | 32.06 |
| WEIGHT-% | 100.00 | 50.00 | 15.00 | 13.73 | 35.00 |
| API | 5.37 | 14.2 | 2.9 | 9.7 | −6.1 |
| Sp. Gr. | 1.0338 | 0.9715 | 1.0526 | 1.0022 | 1.1287 |
| S, wt-% | 4.27 | 3.03 | 5.09 | 0.42 | 5.69 |
| N, wppm | 3000 | 1250 | 3000 | 1700 | 5500 |
| Con Carbon, wt-% | 23 | 7.7 | 23.0 | 8.5 | 44.8 |
| C7 insols, wt-% | 6.86 | 0.02 | 0.1 | 0.05 | 19.5 |
| Ni, ppm | 24 | 2.0 | 14.4 | 0.5 | 59.6 |
| V, ppm | 94 | 5.2 | 30.2 | 1.0 | 248.2 |

In another embodiment of the invention, selective hydroprocessing of the resin stream reduces the overall hydroprocessing costs by avoiding raising the severity of the VGO and DAO hydrocracking severity.

In certain embodiments of the invention, for applications where the downstream VGO hydrocracking process has feedstock quality limitations, the hydroprocessed resins is separated in an extractor into hydroprocessed resin DAO and hydroprocessed resin pitch streams. The selected lift in this extractor is set by the VGO hydrocracker feed quality limitations. Typically this DAO yield is over 50 W % of the hydroprocessed resin stream. Table 4 compares typical SDA yields versus the combined SDA/resin hydrotreater with selective separation yields for typical sour crude vacuum. The hydrocracking process feedstock is increased by another 12 W % of vacuum residue and the potential coke yield when the SDA Pitch is coked is decreased by another 13 W %.

TABLE 4

| | | Conventional SDA | | FW SDA-RT | |
|---|---|---|---|---|---|
| | FEED | DAO (HC limited) | PITCH | DAO (HC limited) | PITCH |
| VOL-% | 100.00 | 53.2 | 46.8 | 65.4 | 34.9 |
| WT-% | 100.00 | 50.0 | 50.0 | 61.0 | 38.4 |
| API | 5.4 | 14.2 | −3.4 | 15.2 | −7.2 |
| S, wt-% | 4.3 | 3.0 | 5.5 | 2.6 | 5.2 |
| N, wppm | 3000 | 1250 | 4750 | 1200 | 5300 |
| CCR, wt-% | 23.0 | 7.7 | 38.3 | 7.0 | 42.8 |
| C7 Ins., wt-% | 6.9 | 0.02 | 13.7 | 0.01 | 17.8 |
| Ni + V, wppm | 118 | 7.2 | 229 | 6.0 | 280 |
| Potential Coke | Base | | −19% | | −32% |

In an embodiment of the invention, heat integration and elimination of redundant equipment between the SDA and the Resin Hydrotreater reduces the combined capital and operating costs of both processes.

The process of the invention has been described and explained with reference to the schematic process drawings. Additional variations and modifications may be apparent to those of ordinary skill in the art based on the above description and the scope of the invention is to be determined by the claims that follow.

What is claimed is:

1. A method for integrating a solvent deasphalting process and a resin selection process comprising:

adding a solvent to a heavy hydrocarbon stream comprising asphaltenes, resin, and oil;

removing the asphaltenes from the heavy hydrocarbon stream so as to produce a deasphalted oil stream, a solvent solution comprising the oil and a resin fraction, and a pitch fraction;

heating the solvent solution so as to precipitate the resin fraction;

separating the resin fraction from the solvent solution, producing a resin product and a mixture comprising the oil and the solvent;

applying heat to the mixture so as to vaporize a fraction of the solvent;

removing the vaporized solvent fraction from the mixture leaving a resin-free deasphalted oil product;

subjecting the resin fraction to thermal cracking so as to produce a thermally-cracked residue product and a thermally-cracked light product;

subjecting the thermally cracked residue product to an extraction to separate a deasphalted oil product and a thermally-cracked resin pitch product;

combining the thermally-cracked resin pitch product with the pitch fraction;

subjecting the combined thermally-cracked resin pitch product and the pitch fraction to processing in a delayed coker.

2. The method of claim 1 wherein at least a fraction of the solvent is removed with the resin product.

3. The method of claim 2 wherein the resin product comprises about 50% resin and about 50% solvent.

4. The method of claim 1 wherein the resin-free deasphalted oil product comprises about 50% deasphalted oil and about 50% solvent.

5. The method of claim 1 wherein the solvent solution comprises about 10% deasphalted oil and resin, and about 90% solvent.

6. The method of claim 1, wherein the solvent comprises a light paraffinic solvent.

7. The method of claim 6, wherein the light paraffinic solvent is propane, butane, isobutane, pentane, isopentane, neopentane, hexane, isohexane, heptane and mixtures thereof.

* * * * *